United States Patent [19]

Groth et al.

[11] 4,231,668

[45] Nov. 4, 1980

[54] LIQUID POWER DRIVEN COATING APPARATUS

[75] Inventors: Hugh F. Groth; John D. Vogel; Guilbert M. Hunt, all of Brecksville, Ohio

[73] Assignee: The Sherwin-Williams Company, Cleveland, Ohio

[21] Appl. No.: 948,912

[22] Filed: Oct. 5, 1978

[51] Int. Cl.[3] ..... B43K 5/02

[52] U.S. Cl. ..... 401/146; 401/197; 401/204; 401/206; 401/208; 417/477

[58] Field of Search ..... 401/218, 146, 188 R, 401/149, 150, 197, 203, 204, 208, 219, 191; 417/477

[56] References Cited

U.S. PATENT DOCUMENTS

| | | | |
|---|---|---|---|
| 3,135,005 | 6/1964 | Karkut | 401/149 |
| 3,145,411 | 8/1964 | Fischer et al. | 401/188 |
| 3,192,554 | 7/1965 | Karkut | 401/218 |
| 3,358,609 | 12/1967 | Worth et al. | 417/477 |
| 3,447,478 | 6/1969 | Clemans | 417/477 |
| 3,457,017 | 7/1969 | Bastian | 401/204 X |
| 3,749,531 | 7/1973 | Walker et al. | 417/477 X |
| 3,776,645 | 12/1973 | Walker | 401/188 |
| 3,822,948 | 7/1974 | Handl | 401/146 |
| 3,879,140 | 4/1975 | Ritter | 401/188 |
| 4,072,429 | 2/1978 | Terzian et al. | 401/146 |
| 4,113,409 | 9/1978 | Rossmanith | 417/477 |

FOREIGN PATENT DOCUMENTS

| | | | |
|---|---|---|---|
| 264882 | 6/1912 | Fed. Rep. of Germany | 401/146 |
| 2140872 | 2/1973 | Fed. Rep. of Germany | 417/477 |

*Primary Examiner*—Steven A. Bratlie

*Attorney, Agent, or Firm*—Richard G. Smith; Neil A. DuChez; James V. Tura

[57] ABSTRACT

A coatings application apparatus pumps liquid paint through a flexible conduit within a rotary variable displacement peristaltic pump to a conventional applicator head. Through constant speed rotating lobes peristaltic action squeezes coating liquid within the conduit through the paint applicator control handle and applicator.

The control handle permits changes in the paint flow rate. Upon constriction of the conduit within the control handle, flow rate is reduced, back pressure develops with resulting tube distortion. Distortion levered forces act upon a pre-set loaded pump spring. Variation in pump displacement results. The liquid flow rate within the supply conduit is inversely proportional to the back pressure so developed. If fluid flow is completely arrested by full supply tube constriction, back pressure becomes a maximum and pump displacement becomes zero. The pump continues to operate, however, at constant R.P.M., requiring no high starting torque.

The pump unit employes two reverter train speed reduction systems in tandem. A conventional planetary or epicyclic gear system provides a first reduction in R.P.M. The pump rotor element itself, as a secondary reduction unit, allows economy in selection of a high speed, low power, motor drive for the peristaltic pump.

6 Claims, 15 Drawing Figures

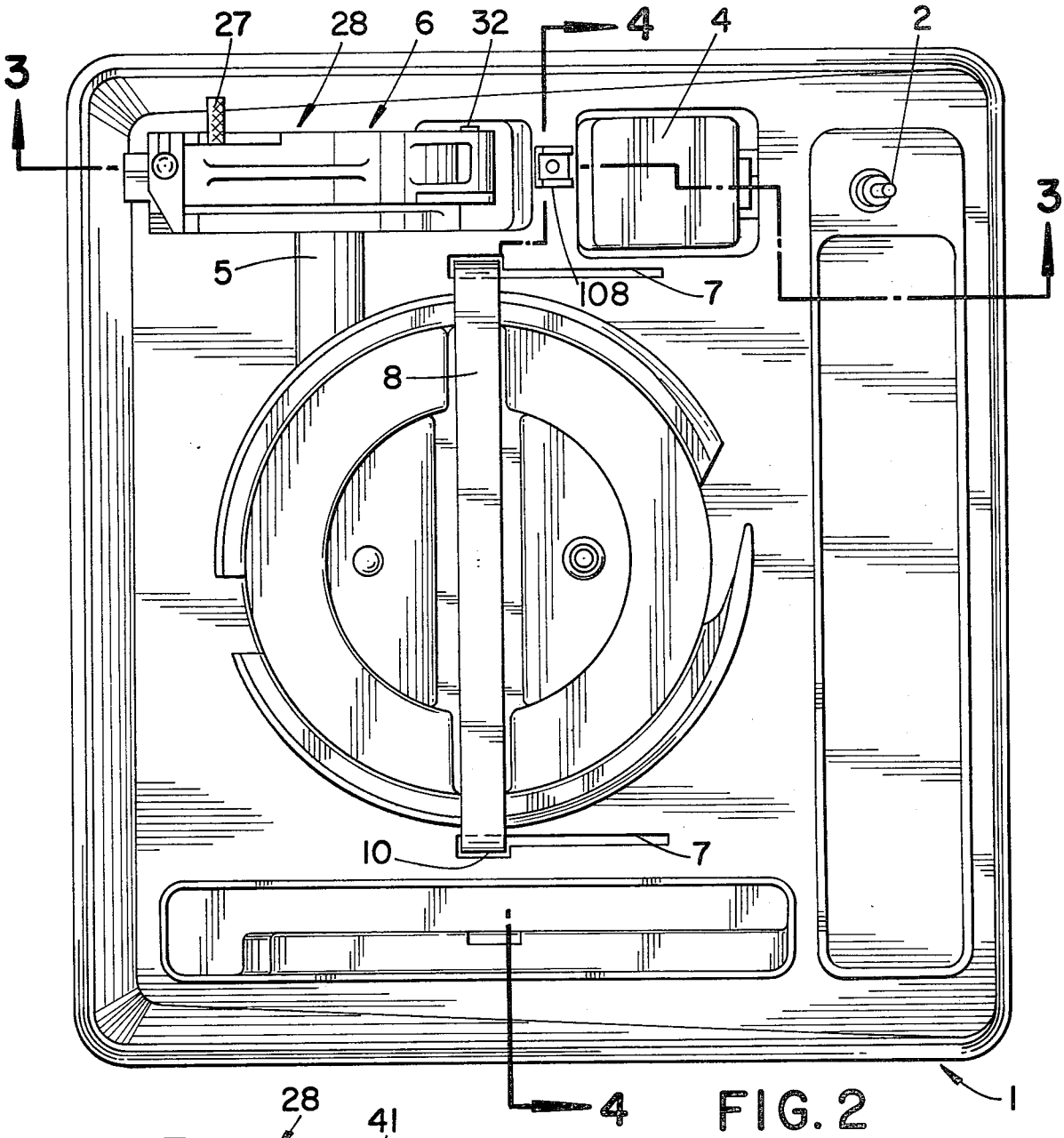
FIG. 2
FIG. 3
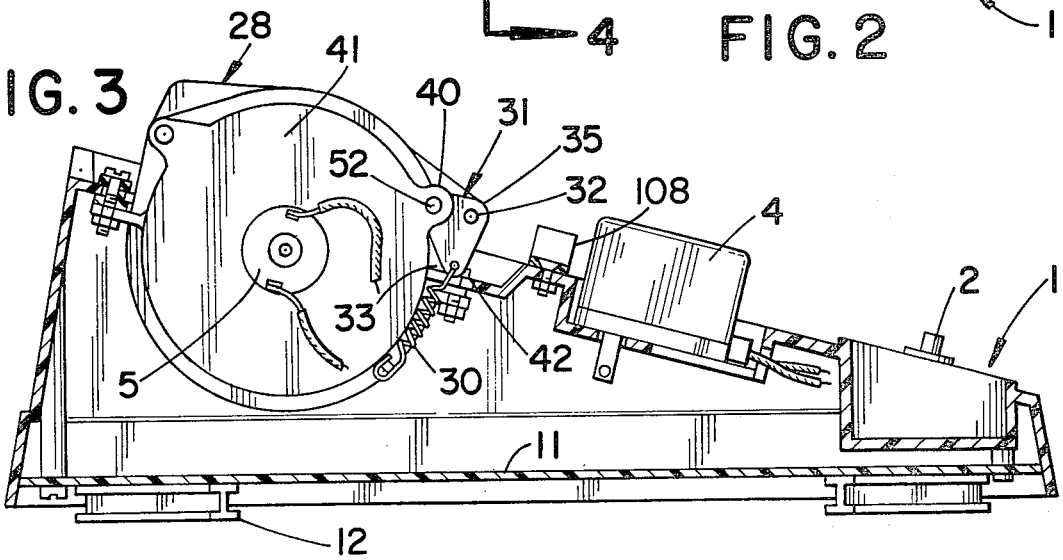

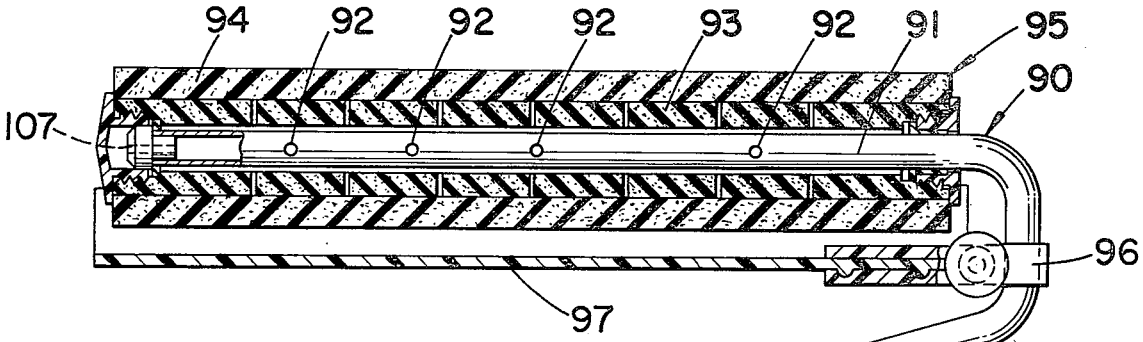
FIG. 7
FIG. 12
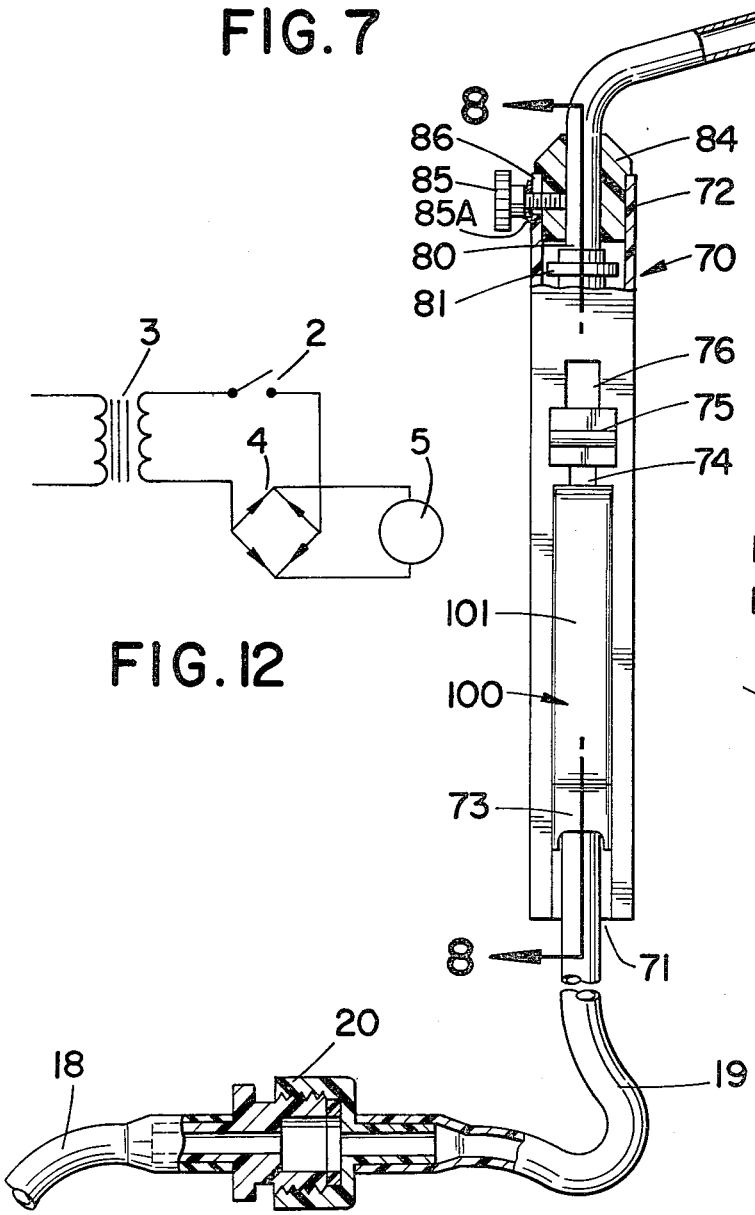
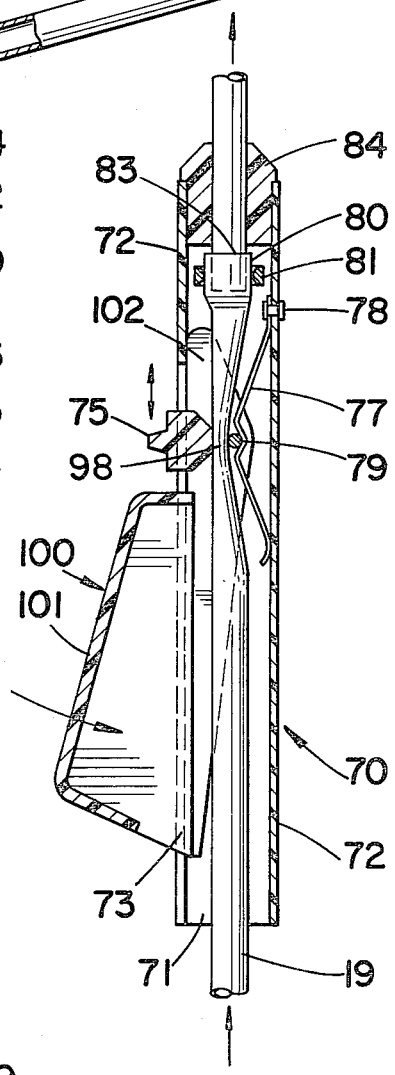
FIG. 8

LIQUID POWER DRIVEN COATING APPARATUS

Application of protective and decorative coatings to large surface areas, particularly in residential end use, is historically, tiring and time consuming. Considerable past effort has been expended in attempting to reduce the time and energy essential to this work. Paint applicator heads have developed through fountain fed brushes, fountain paint rollers and fountain fed long napped paint pads all of which have been used in connection with paint supply tubes designed to carry liquid coatings from the coatings liquid supply to reservoirs at the point of application in the application head in efforts to reduce time and energy demands in paint application. Three representative U.S. patents, namely Fischer U.S. Pat. No. 3,145,411; Karkut U.S. Pat. No. 3,192,554 and Ritter U.S. Pat. No. 3,879,140 are generally illustrative of the state of development of the art at the time of this invention and of problems inherent in attempts to aid in reducing energy and labor requirements and increasing the control of the quality of coatings applications.

The present invention provides an apparatus for application of protective and decorative coatings remarkably simplified in its overall design, use and cleanup operation. Original supply containers of standardly merchandised container sizes fit the machine. Both the overall weight of the entire paint application apparatus and the weight of the applicator head in use have been reduced to a basic minimum. During use of the apparatus, one needs manually to lift, transport and apply in the system only that quantity (weight) of coating as is being immediately spread out on areas being painted.

The flow control at the point of application at any time can be as much, little, or none as the operator desires.

A variety of paint applicator heads can be adapted to use including fountain type brushes, fountain type rollers and fountain cloth pads, although rollers and pads useful here have been specifically designed for adaptation to the present system.

Perhaps the most unpleasant job of all in residence (do-it-yourself) painting is cleanup. Here, final cleanup of equipment, particularly where water-reduced coatings are employed, is reduced to a minimum.

The advantages and the advance in and use of the herein disclosed powered apparatus for coatings application will be apparent from the following description in conjunction with the drawings which develop the preferred embodiment of the apparatus as of the present time.

FIG. 2 is a top view of the machine as in FIG. 1 with certain portable elements removed.

FIG. 3 is a partial section along line 3—3 of FIG. 2.

FIG. 7 is a top view of one applicator head and the control handle receptive thereof, partially in section.

FIG. 8 is a sectional view of the control handle of FIG. 7.

FIG. 12 is a simplified, schematic wiring diagram.

Figure 10:
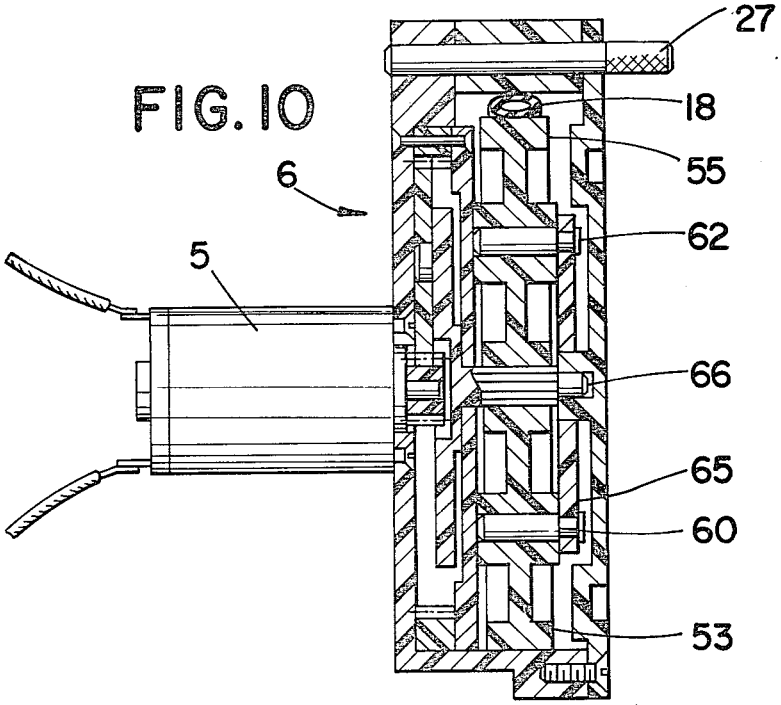
FIG. 10 is a partial sectional view of the pump as in FIG. 9 along the section line 10—10.
Figure 15:
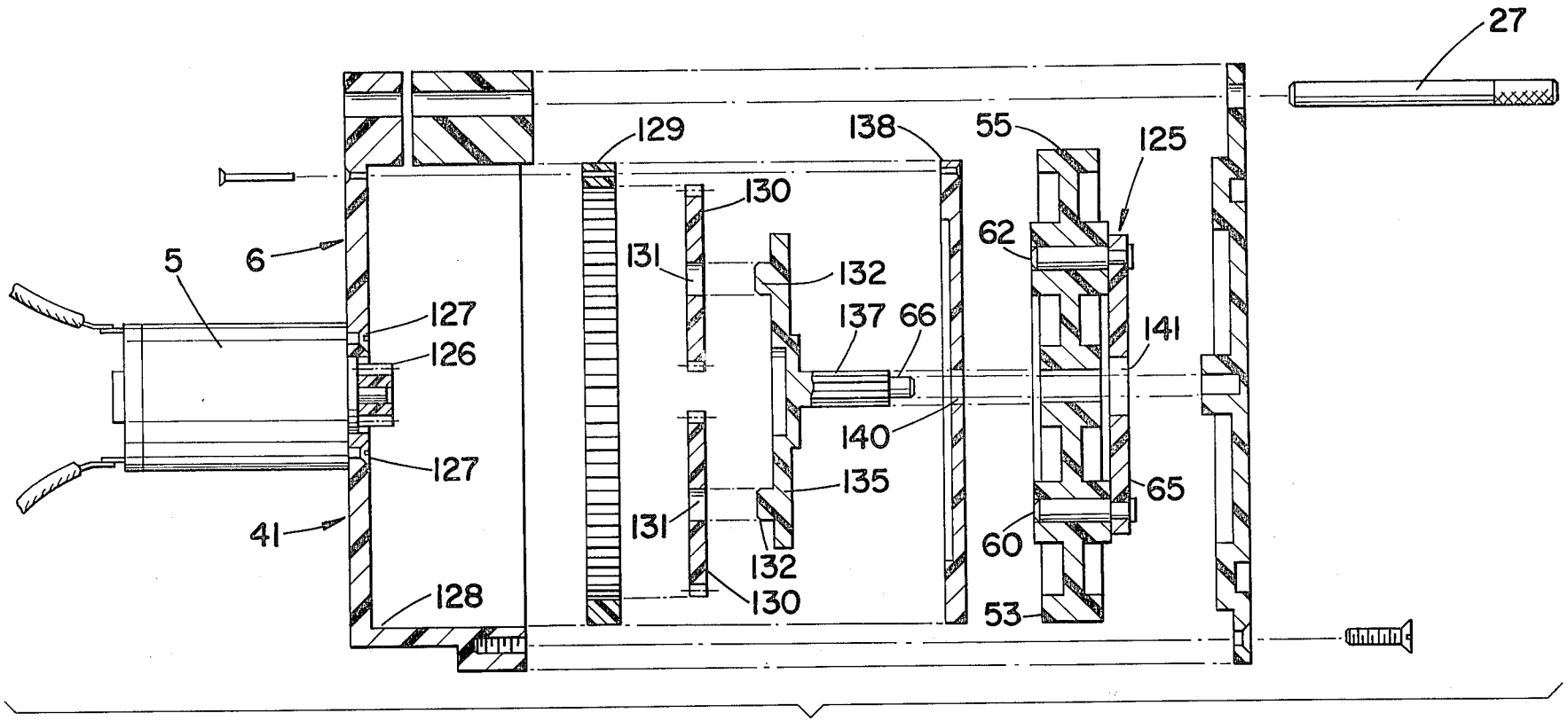

FIG. 15 provides an exploded view based on FIG. 10, detailing elements disclosed therein.

Figure 1:
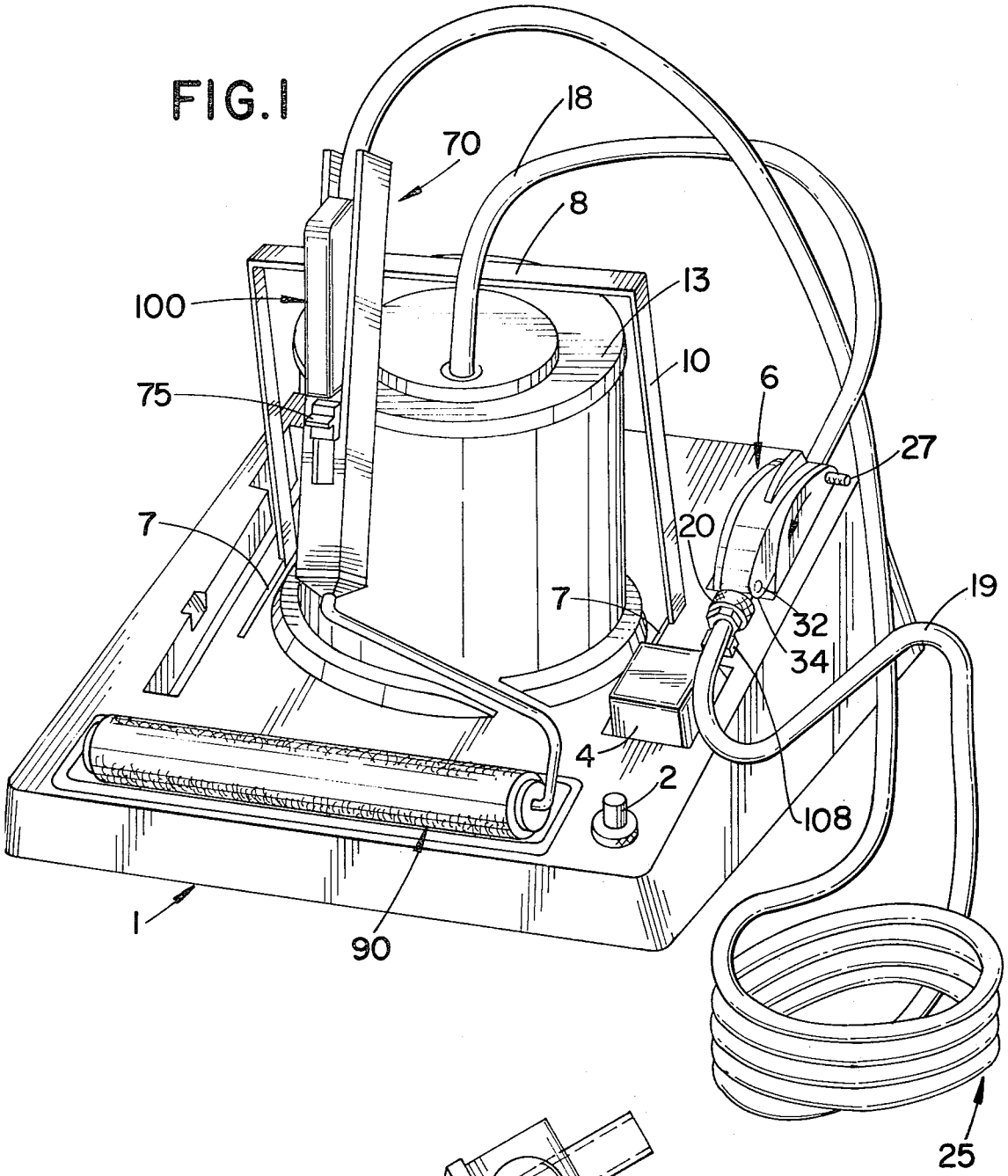
FIG. 1 is a perspective three quarters front view of the assembled painting machine.

A preferred embodiment of the coating machine of this invention as disclosed in FIG. 1 is carried in an injection-molded plastic base 1 in which a plurality of parts receiving recesses and a channel guide are integrally formed. Stop switch 2 is intermediate between 110/15 volt transformer 4 and a 15 volt peristaltic pump motor 5, the drive shaft of which operates through two speed reduction systems, the first of which is the well known planetary gear system and the second is also, in effect, a second planetary friction reduction utilizing however adaptation of other essential functional elements of the pump 6 itself in a speed reducing capacity as will be described more fully hereafter.

Figure 5:
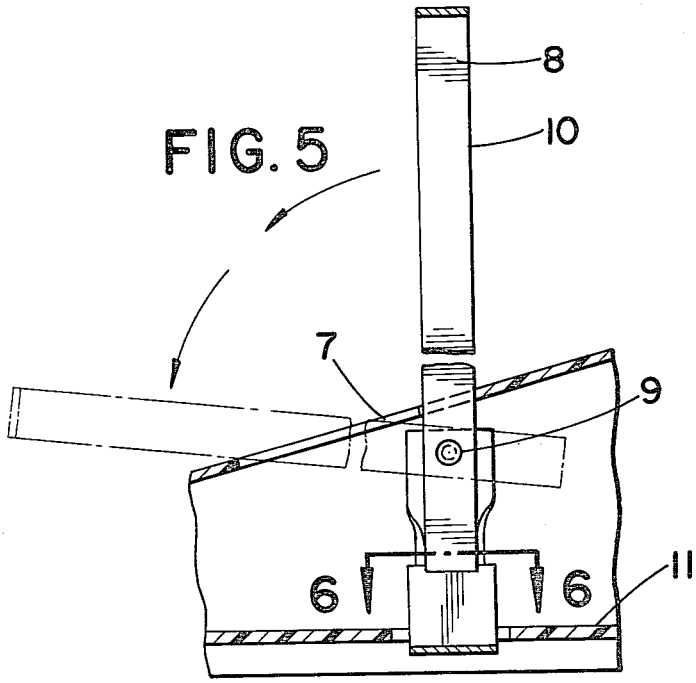
FIG. 5 is a section along line 5—5 of FIG. 4.
Figure 6:
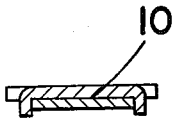
FIG. 6 is a section along line 6—6 of FIG. 5.
Figure 9:
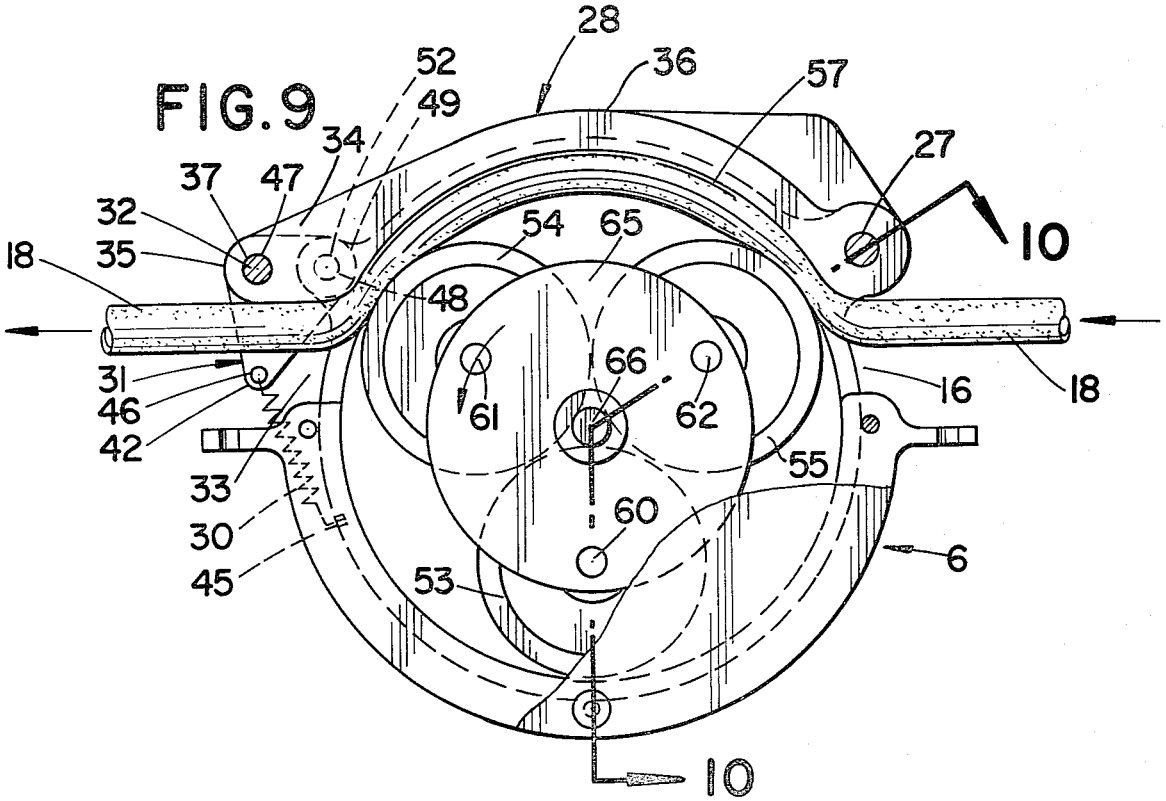
FIG. 9 is a view of a peristaltic pump, as modified, with parts removed.

A fold down handle 8 mounts in handle slots 7 of base 1 as shown in FIG. 5 and is rotatable about pivot pins 9 from a vertical handling position where it is held upright by the slot 7 design to carry the portable unit and upon squeezing the vertical handle sides 10 inward can be moved out of the way during actual use.

A base plate 11 mounted under the injection moulding is designed to fit over an opened five gallon can 15 when it is the source of the coatings liquid. Guide bars 12, radially mounted to the underside of base 1 serve to center and to prevent the entire coating apparatus assembly from accidental removal from atop can 15 support when the five gallon supply tank is in use.

Base 1 formed inwardly and downwardly from the top to provide coatings reservoir support means comprises two concentric hollow cylinders, a quart size 14 and concentrically exterior thereof a gallon size 13 which are adapted to position and hold commercially available correlatively sized paint supply containers, if selected.

Hole 17, centrally through base 1 and base plate 11 accomodates a flexible, surgical latex siphon supply tube 18 which has a first end of a length sufficient to extend to the bottom of five gallon can 15 (when such is used). Siphon supply tube 18 is of sufficient length to be extended by means of its opposite end length through rotary pump 6. Material selection of tube 18 is critical as it must be able to withstand continuous diametrical distortion of the tube sidewalls as its interior volume is diminished by alternate compression and expansion of walls thereof due to their sequential deformation in pump 6—rotor lobes 53, 54, and 55 as they rotate and collapse the side walls thereof. Pump 6 in operation simulates rhythmic progressive waves of compression and diameter constriction in tube 18, suggesting peristalsis, hence the preferred variable displacement pump for the present use can be generically identified as a "peristaltic" type rotary pump.

A plastic garden hose union fitting 20 provides a detachable union between flexible siphon supply tube 18 and a longer extension supply hose 19 (we find a vinyl tubing MP-1-60 of Mercury Plastics satisfactory) joined through union fitting 20. The two element flexible liquid supply line has the advantages of better wear in initial siphon tube 18, with satisfactory performance character in the vinyl material for the longer extension hose 19. Together they are sometimes identified herein as flexible liquid supply line 25.

In use, the free end of siphon supply tube 18 is inserted downwardly through base hole 17 into the selected coatings supply container to the approximate bottom thereof. The opposite end is stretched over the hose receiving portion of the union 20 fitting.

Removable gate locking pin 27 above entry port 16 (for supply tube 18) of pump 6 is removed from the pump gate 28. Pump gate 28 is a one piece moulded arcuate section of pump 6 forming the top or stator section 36 of the pump and extends from exit port 33 to entry port 16. Pump gate 28 can be further released by lifting the now freed end upward to pivot about exit pivot pin 32 directly above exit port 33. Note the existence of offset 34 in the exit end of gate 28. One function of offset 34 is to keep the lobes 53, 54, and 55 in contact with siphon tube 18. Additionally, through this offset clearance between the outer periphery of pump rotor lobes 53, 54, and 55 and offset 34 can be increased by such lifting by pivoting about exit pivot pin 32, but by applying further upward force on the pump gate offset 34, working against load spring 30 additional clearance can also be obtained. Doing this, of course, loads spring 30 in relation to the additional clearance thus obtained.

The mechanical action occurring at and about outlet port 33 provides the variable displacement characteristics of pump 6. Primary control movement takes place through pump gate offset 34 of gate 28 and its pivotal action in conjunction with a triangular metal plate 31 having three apex ends, namely; lower apex 42, central apex 35 and upstream apex 49. Each apex end is bored. Lower apex hole 46 is the point of attachment of the movable end of load spring 30 and the fixed lower end 45 thereof is anchored in the pump housing. Central apex end 35 bore hole 47 accomodates forwardly directed entry pivot pin 32 the rearward end of which is fixed in metal plate 31 hole 47 but freely rotatable in the horizontal downstream hole 37 of pump gate offset 34. This arrangement provides a first point of rotation for pump gate 28 when offset portion 34 of the offset gate is subjected to movement upwards or downwards after the entire pump assembly 6 is in operating condition with supply tube 18 threaded through the pump 6 and over lobes 54 and 55 as shown with locking pin 27 in position.

The third attachment hole 48 of triangular plate 31 has a short axial pivot pin 52 one end of which is fixed in plate 31, the free end of pin 52 extending in the opposite direction from plate 31 as does exit pivot pin 32. The free end of pivot pin 52 provides a center of rotation in horizontal bearing hole centrally of lug 40 (FIG. 3) which is on part of the machined plastic rear face plate 41 which is an integral part of the exterior housing of pump 6.

Triangular metal plate 31 and gate 28 plastic offset 34 in assembly are both rotatable about axial pivot pin 52 counterbalanced by the resistance provided when load spring 30 is extended by such movement. The maximum pressure developed within pump 6 is controlled through load spring 30 and the load essential to its deflection.

Figure 14:
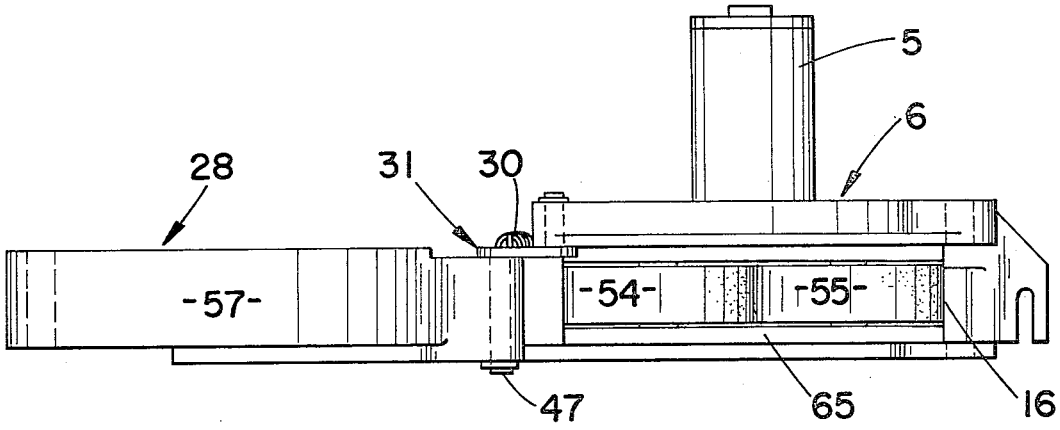
FIG. 14 is a top view of the peristaltic pump of FIG. 3 the variable clearance stator element pivoted open about the inlet port detailing pressure responsive means.

Upon removing locking hinge pin 27 and lifting that end of gate 28 will rotate offset 34 integrally therewith counter clockwise and in the direction of rotation of the pump lobes 55, 54 and 53 and release all tension previously existant in spring 30 (FIG. 14).

With pump gate 28 rotated to fully open position, the hose fitting 20 end of siphon supply tube 18 is threaded interiorly of the pump 6 housing. With hose fitting 20 downstream of the pump several inches, siphon supply tube 18 is fitted underneath the offset 34 of gate 28 at exit 33 and over the free spinning circular impeller lobes 55 and 54. Gate 28 is then rotated clockwise back to its home position and downward over the outside arc formed by supply tube 18. Inner surface 57 of gate 28 is then in slightly deforming pressure contact with the arc formed by the supply tube. The removable locking pin 27 is replaced in the "home position".

The second plastic supply tube or hose section 19 is attached through hose fitting 20 and pump 6 is thereby assembled in operating condition. Upon indicated rotation of the pump motor 5, inner smooth arcuate surface 57 of stator section 36 of gate 28 supports siphon tube 18 snugly and firmly thereagainst, pressure forcing the tube outward from the peripheral contact of the free-spinning circular impeller lobes 55, 54 and 53.

The surfaces of siphon tube 18 opposite surface 57 is intermittently and outwardly periodically deformed along an arc at the point of tangency with the circumference of circular impeller lobes 55, 54, and 53. Impeller lobes 53, 54, and 55 freely rotate about their centers on axes 60, 61, and 62 which in turn are fixedly attached to an impeller frame disk element 65.

Operation of the rotor element 125 within the pump 6 is of considerable interest as it not only provides the peristaltic action on siphon tube 18, but in cooperation with a first epicyclic reverter gear train reduction system makes possible use of a small drive motor 5 through the fact that it is also used to effect a second epicyclic reverter frictional train speed reduction similar to the first geared speed reducer.

Referring to FIG. 15, an exploded view of the pump 6 assembly and motor and double speed reduction system can be followed as it has been presently developed.

The 15 volt motor 5 has an approximate speed of about 1,750 R.P.M. which drives pinion gear 126. Motor 5 is anchored to the interior of pump housing 128 by screws 127. A fixed epicyclic circumferential internal gear ring 129 is screwed fast to the interior of pump housing 128. Three equally spaced planetary gear wheels 130 are centrally drilled 131 to rotate on axial stubs 132 which are fixed 120° apart on a first circular rotary disk frame 135. Disk frame 135 is rotated through action of pinion gear 126 driving the three planetary gears which mesh within the internal gears of ring 129. Rotation of disk frame 135 causes the splined shaft 137 to rotate at the same R.P.M. as frame 135. A centrally bored cover plate 138 seals off the first gear reduction system and allows lubricants to be isolated within the said gear train assembly space. Driven spline shaft 137 extends through the central bore 140 of cover plate 138 and through the second disk frame 65 oversize hole 141. The assembly 125 provides sufficient clearance between the three cylindrical rotor lobes 53, 54 and 55 so that with siphon tube 18 removed, rotation of spline shaft 137 is not in sufficient pressure contact at its point of tangency with the exterior circular periphery of the lobes 53, 54 and 55 to cause their rotation and consequent rotation of the second disk frame 65. However, when the siphon tube 18 is in place and the stator gate 28 is closed and pin 27 holds the pump in operative assembly, pressure of gate 28 and tube 18 on impeller lobes 54 and 55 presses them, as shown into gear-like driving contact with the peripheral, resilient exterior surface of the pump lobes causing rotation about their axes 60, 61 and 62. The pressure developed interiorly of the pump housing 128 against the interior wall circumference thereof also causes the lobes to act as "planetary gears" but through their first described frictional contact with spline 137 and the interior pump housing wall 128. The second disk frame assembly thereby rotates, in turn, operates at a reduced speed.

In the specific pump operation a very efficient and inexpensive speed reduction has thereby been obtained through use, in cooperation, of a first reverter epicyclic gear train speed reduction system starting with a pinion gear 126 having 15 teeth, driving a set of three equispaced planetary gears where one revolution of the planetary gear requires $4\frac{1}{3}$ revolutions of the pinion gear. Further speed reduction results from the requirement of about 2.5 revolutions of the planetary gears to give one revolution of the first circular driven rotary disk frame 135. This causes the driven splined shaft 137 to make one revolution. One rotation of each of the circular pump lobes 53, 54 and 55 requires about 6.5 rotations of the spline shaft 137. In turn, about 2 rotations of the pump lobes are required about their centers 60 and 62 to cause one rotation of the rotor assembly or impeller frame disk 65.

Discounting slippage in purely frictional (not geared) rotational reductions, we expect, therefor, about 140 revolutions of the driven spline shaft 137, which means 140 5/6 revolutions of the pinion gear 126, essential for one revolution of the pump. The effective gear reduction of approximately 140 to 1 through the above combination has made the motive power source less demanding, reduced the spacial requirements of the rotational reduction system to a most advantageous level and reduced the requirements for precision cut geared elements by approximately one half. It is anticipated that the rotary pump will operate at about 12.5 R.P.M. when the motor speed is about 1750 R.P.M. and deliver under maximum paint or coating demand approximately three gallons per hour. Thus, the impeller lobe elements essential to the pumping activity of the peristaltic rotary pump serve a dual function and provide a parallel reverter friction train speed reduction system as well as the required volume delivery desired. When the motor speed is about 10,000 R.P.M., the pump operates at about 70 R.P.M.

It can be seen that as motor driven pump disk 65 is rotated toward the exhaust port 33 impeller lobes 53, 54 and 55 engage and deform segments of arc of siphon tube 18 as they in turn pass and engage the tube 18 at entrance port 16. As pump lobes rotate in deforming contact with tube 18, reduced pressure thereby created in tube 18 draws up liquid coating which is captured in separated segments of tube 18 as each impeller lobe goes through its 120° of arc. As the lobes 55, 54, and 53 each pass through stator section 36 of the interior pump arc entrapped segments of liquid in tube 18 of coating liquid are pumped downstream and out the outlet end 33 of the pump 6.

For as long as very limited back pressure develops in the liquid supply line 25 and load spring 30 is not deflected by development of appreciable back pressure the flow rate of the pump within tube 25 changes very little and pump 6 operates at design level efficiency with no appreciable variance in displacement volume and pumping rate. The impellers operate at the same rate, so long as current flows through switch 2 and motor 5. However, the pump displacement rate varies with back pressure development.

Figure 11:
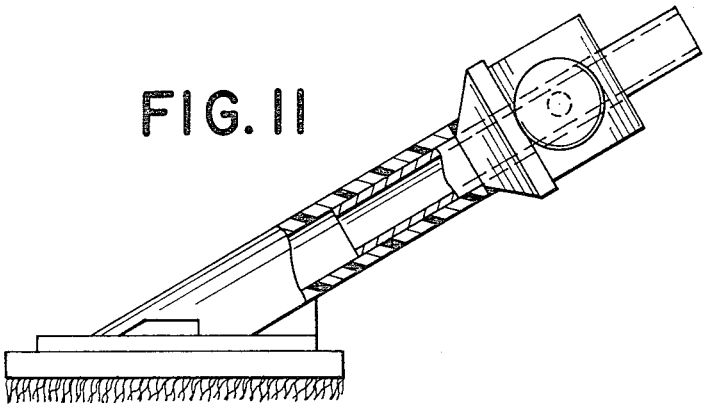
FIG. 11 is a side view, partially in section of a fountain applicator pad.
Figure 4:
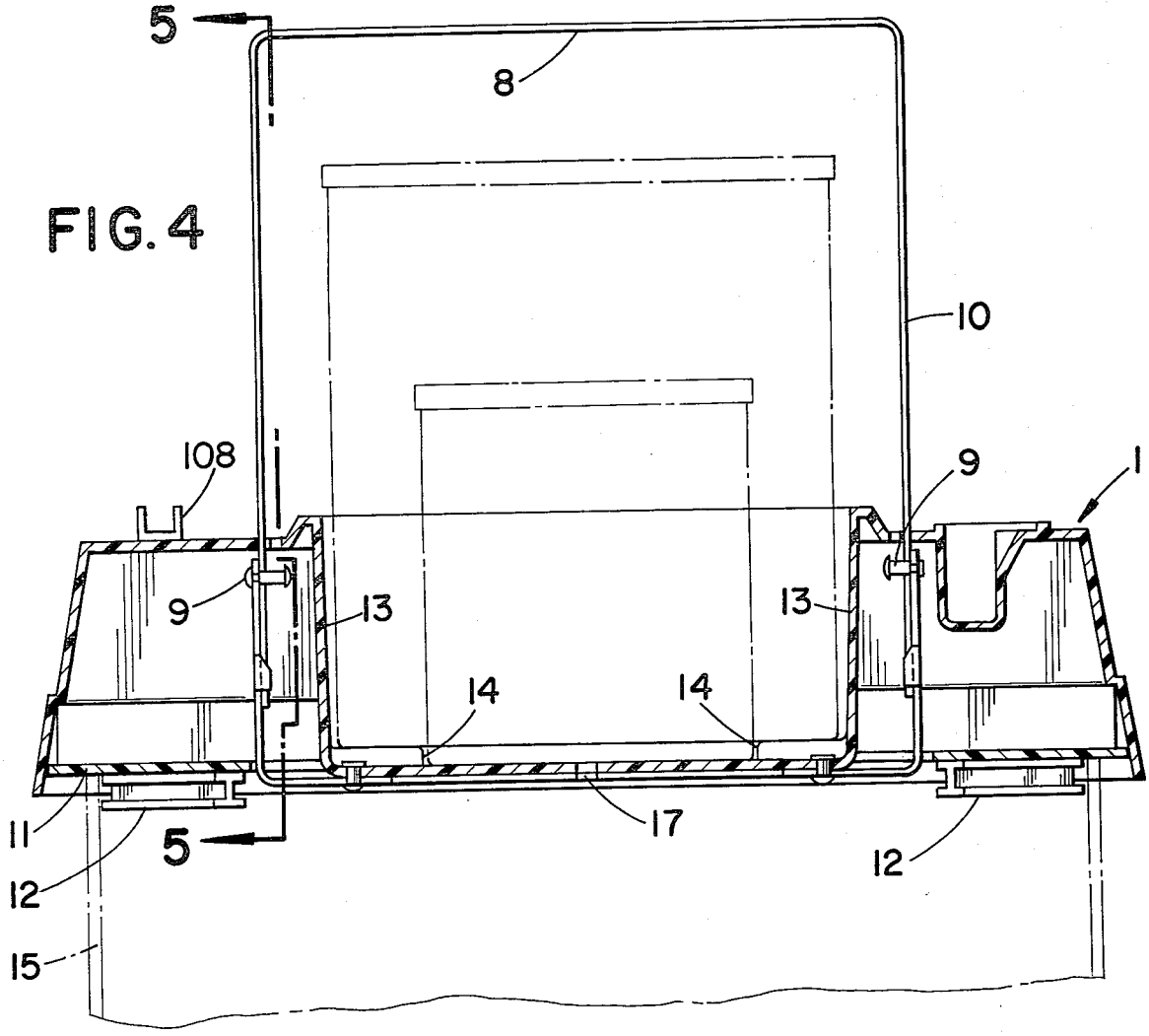
FIG. 4 is a section along line 4—4 of FIG. 2.

Liquid coating composition flows downstream and through control handle 70 into any selected one of the several paint applicator units of the fountain type (applicators that are fed from interiorly where the liquid coating is forced outwardly through porous roller, (FIG. 7) or pads (FIG. 11), or longitudinally assembled bristles to form brushes (not shown).

As the liquid coatings flow, they pass through control handle 70 and the selected fountain applicator and the applicator surface, the coating is applied to the wall surface at the point of contact of the applicator with the wall surface. However, flow rate at this point is controlled by exercise of the operator's judgment as to requirements for liquid coating to be supplied on the surface being painted. This is accomplished through flow restrictive means, acting on the exterior of hose 19 as pumped liquid coating passes through control handle 70 next adjacent the selected applicator means.

The applicator control handle 70 has several unique features which herein combine in the painting machine described to provide minimum weight for the coatings applicator to move, and yet also provides a flow rate control of liquid (or complete stoppage of flow rate) readily adjusted to the instant desires of the operator, the coating being applied and the conditions (porosity, roughness, color, hiding, etc., factors) of each varying surface to be coated can be compensated for by restrictive controls herein provided within the rheological limits of the liquid coating quality selected for the specific job at hand.

Applicator control handle 70, illustratively used with fountain roller coater applicator 90 in attachment as has been principally illustrated in FIGS. 1, 7, and 8 and discussed herein.

FIGS. 7 and 8 illustrate a presently preferred embodiment detailing construction of both control handle 70 and roller applicator 90 removably affixed thereto.

Control handle 70 is manufactured from a hollow, square section, extrusion of aluminum metal having a body wall 72 of approximately one inch width and about one tenth of an inch thick. An upstream inlet end 71 defines the origin of a longitudinal handle slot 73, slightly less wide than tube delivery supply hose 19 wall extending through the handle body wall and the slot extends downstream in the handle about one third its length. Trigger 100 a solid plastic integral piece is adapted to be slid into this first control handle slot 73, stopping against a second stop slot 74 of narrower dimension cut into the wall along the same center line as slot 73. A third stop button slot 76 downstream of the stop slot 74 of handle 70 slideably engages a stop-on control button 75 which assists in flow rate control modification and to completely stop material flow in hose 19, upon operator movement thereof upstream in its respective slot 76.

Directly opposite stop button 75, interiorly of the handle 70 wall is control handle arcuate leaf spring 77, one end of which is riveted to the handle wall by rivet 78. The highest arcuate portion of spring 77 has a detent locating rod 79 to exert pressure against the exterior wall of supply hose 19. Stop button 75, in its sliding engagement in slot 76, advanced to its extreme position downstream exerts the least constrictive pressure on hose 19, and when in its extreme upstream position maximum constrictive pressure on supply hose 19. Variations therebetween are inherent in the design to assist in providing graduated flow rate control in the flexible supply line 25.

Figure 13:
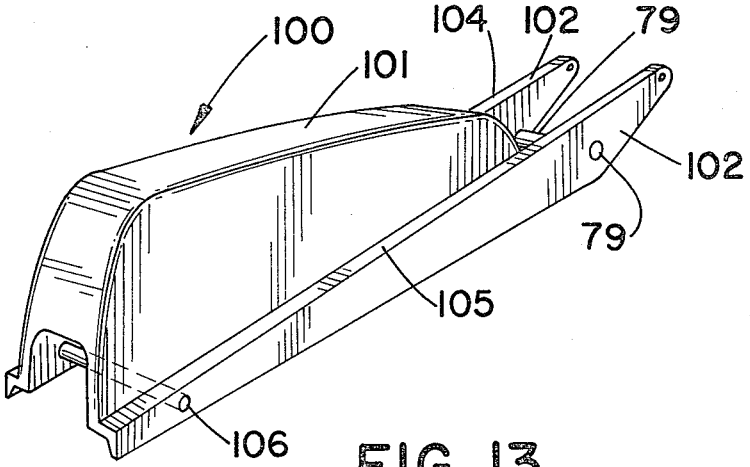
FIG. 13 is an enlarged perspective view of the trigger control element 100.

Variable flow rate control trigger unit 100 is slideably mounted interior of slot 73. It is moulded from a single plastic block and grossly resembles a sled (see FIG. 13) with spaced apart solid sled runners 102 which slide interiorly of control handle 70, runners 102 straddling delivery tube 19. A tapered trapezoidal block functioning as a finger block or finger control 101 is centrally mounted longitudinally on the top of sled runners 102 leaving a pair of horizontal shoulders 104 and 105 exposed on each side of said finger block control 101. These shoulders 104 and 105 slideably engage the interior wall area defining the initial wide slot 73, bearing inwardly and upwardly interiorly against the horizontal walls defining slot 73.

Trigger control handle 100 is slid into the slot 73, downstream and straddling tube 19 to the stop position created by narrowed slot 74, or to its "home" position. A transverse pin 106 fixes flexible supply line 25 between runners 104 and 105 so hose 19 cannot be pinched off without positive intent. Solid sled runners 102 have a solid transverse tube capsizing support rod 79, located at the point of greatest curvature in the runners, the outer ends of rod 79 are mounted flush with the outside walls of runners 102 and rod 79 sets in the detent as shown. The resultant forces created hold the parts in operable assembly.

In the normal or non-deflected or non-depressed position finger trigger handle 101 or trigger control unit 100 tube capsizing support rod 79 is diametrically opposite transverse rod 79 side of tube 19 from stop button 75 when in its off or extreme upstream position. Under this position, supply tube 19 is substantially fully constricted therebetween, a resultant of the resolution of forces created through upward pressures of the detent of arcuate spring 77, which provides a "dead man" control of liquid flow through supply tube 19, or substantially zero liquid flow rate.

Full flow of coating liquid downstream in supply hose 19 likewise occurs when trigger control 100 finger trigger handle 101 is completely depressed by squeezing control handle 70 and trigger control 100 together. Additionally, stop button 75 can be slid toward its extreme downstream position. It is noted in such case that the constrictive action of transverse support rod 79 completely depresses the arcuate spring 77 and the sled runner curved section becomes a fulcrum about which the extreme downward end of handle 101 acts to depress spring 77 to remove all restrictions or constrictions in supply hose 19. Obviously, controllable variations between full flow and no flow are under full control of the operator to provide his choice of flow rate at any given period in his application work by the constrictive flow control assembly of control handle 70.

Roller coater applicator 90 is assembled to the egress end of control handle 70 and delivery supply hose 19 as follows: Supply hose 19 and 80 downstream from pump 6 is first longitudinally threaded between the runners 102 and held therein by pin 106 of the trigger finger control 100, easier done with control 100 slideably separated (by upstream release motion) from control handle 70. Supply hose 19 is passed upwardly over transverse support rod 79 and downstream through control handle 70 until free end 80 extends forward of the handle a convenient workking distance. Hose 19 free end 80 is slid through tube binder slip ring 81 and then over the hollow aluminum entry nipple or tube entry port 83 and the binder slip ring 81 forced over the overlap of the juncture of tube end 80 and tube entry nipple 83 to seal and prevent possible leakage under pressure of the described union.

The applicator attaching plastic union block 84 is of generally cubic construction centrally bored through one dimension to accomodate insertion therethrough of aluminum tube entry nipple 83. Normal to said first bore is a threaded set screw 85 in one of the cubic faces of 84 which slides through a spring loaded lock washer 85-A into a small slot 86 in the downstream end of handle 70 when the delivery hose 19 is drawn upstream through handle 70. Upon tightening set screw 85 the roller applicator 90 is held in home position unable to rotate in the handle 70. Trigger finger control plastic block 100 is now forced downstream slideably engaging in slot 73 and coming to home position upon meeting the smaller stop slot 74. Transverse support rod 79 now acts transversely of tube 19 to constrict delivery through tube 19. Stop button 75 slid in an upstream direction, completely constricts delivery hose 19 at constriction 90 flow control point. Downstream from the union block 84 having set screw 85 to hold the roller coater applicator in the handle and holding control handle 70 in operative engagement with roller applicator 90, hollow aluminum roller coater handle 90 is bent as shown to provide a radially bored hollow axis of rotation 91 for said applicator roller 95 at right angles to the control handle 70. The hollow axis of rotation 91 is provided with a plurality of radially bored feed holes 92 through the walls thereof to allow fluid coatings pumped through supply line 25, control handle 70 and hollow axis 91 to force liquid coating outwardly therethrough. Bearing 107 has a hole laterally centered therein which allows limited egress of paint during use and permits pain retention in the space between hole 92 and the bearing 107 tip if absent. A porous roller coater support 93 and the exterior open foamed structure of the outside layer coating of porous elastomeric pad material cover 94 define the cylindrical applicator surface contact means to contact surfaces to be wetted and refinished with a liquid coating application when the coating apparatus is in use.

Clamp 96 attaches to bent handle 90 and supports plastic tray 97 to aid in control of liquid coating from splattering downwardly from roller 95.

To illustrate operation and use of the just described completely assembled automatic paint delivery apparatus presume paint supply receptacle 13 to be loaded with a gallon can of paint (recently removed from a paint shaker or recently thoroughly mixed) and the free end of pure gum rubber flexible siphon supply tube 18 is positioned in the bottom of the contained liquid. The painter-operator depresses switch 2 (his foot may be convenient to activate the switch) transformer 4 being plugged into a 110 volt supply. Energized 15 volt motor 5 begins to rotate the pump impeller lobes 53, 54, and 55 and sub-atmospheric pressure is created in siphon supply tube 18. Upon sliding control handle 70 stop button 75 in a downstream direction, the constriction in the extension supply hose 19 within control handle 70 is reduced. Air in the supply line 25 is displaced. Liquid coating composition begins to flow upward in siphon tube 18 and downstream from the gallon supply container at 13 positioned in injection-molded base 1 into the vacuum created in siphon supply tube 18 by pump 6. Sequential action of impeller lobes 55, 54, and 53 as they rotate counterclockwise past entry port 16 squeeze the liquid coating between gate 28 and the exterior periphery of the impeller lobes 55, 54 and 53 forcing the liquid downstream in conduit supply line 25. As the coating supply passes through control handle 70, operator can modify the control by finger pressure on the trigger block 100. The more pressure the faster the flow through the less constricted supply hose 19. Pressure release of the trigger block re-forms at least a partial block or constriction in supply line 25.

As the paint is delivered from the paint applicator 80 surface 94 to the wall surface being painted and the flow be found to be in excess of the operator's requirements, finger release of trigger handle block 100 will reduce flow and increase back pressure in the liquid supply line 25. The arcuate spring 77 acting inwardly against transverse control pin 79 causes some degree of constriction in supply hose 19 as generally indicated at 98 in FIG. 8. The operator may also slide stop button 75 upstream which continues to increase the constriction, and hence the flow rate through the control handle 70, until all flow ceases should he wish to do so. The saddle or detent in spring 77 receives the pin 79 and holds the control handle assembly 70 in position and assembly.

As the flow rate is increasingly reduced, the back pressure in the hose 19 and the siphon supply tube 18 is increased which tends to expand the diameter of the siphon supply tube 18, which in turn tends to cause the arc thereof interiorly of the pump to straighten out. As this back pressure increases, it acts against control spring 30 by the upward thrust on gate 28 offset 34 at exit port 33. Offset 34 is lifted upwards. The general result is a gentle pivoting about gate locking pin 27 which decreases the deformation of the siphon tube 18 by increasing the clearance between the rotary lobes 55, 54 and 53 and the interior surface of the stator gate 28 and offset 34.

As this clearance between the rotors and stator is increased, there is decreasing peristaltic action occurring on exterior siphon tube 18 and its interior content. The efficiency of the variable displacement rotary pump decreases—or the displacement or flow becomes less—and if the back pressure developed by constrictions described in control handle 70 becomes a maximum, the flow rate ceases entirely. The load control spring 30 acts through the lever arm created between pins 52 and 32 in the triangular metal assembly plate 31 which provides in turn control of the clearance between the exterior periphery of the rotating lobes and the stator gate assembly 28.

By movement of stop button 75 of control handle 70 upstream, or backwards toward the point or origin of the coating, the operator can further, by increments, restrict the flow rate until it ceases altogether. At this point back pressure is a maximum and the flow rate can be shut off completely. The operator, if he wishes, may then shut off the pump by means of electrical switch 2.

An extension handle (not shown) is provided which permits one who wishes to paint floors or ceilings without stooping or working from a ladder. The extension handle is made of the same square section extruded shock as handle 70—having a longitudinal slot the full length thereof, to accomodate longitudinal insertion therein of supply tube 19.

To use the extension handle one merely loosens the set screw 85, moves stop button to the downstream extreme and pulls through handle 70, by depressing trigger handle 100, enough delivery tube 25 to allow the union block 85 to be reset in the downstream end of the extension handle and the set screw is retightened against the lock washer 85-A. The opposite end of the extension handle slips interiorly of the downstream end of the control handle 70 and is fastened in position with a similar set screw in a similar applicator union block to 84.

After completion of the day, or a desire to change color, equipment cleanup the bane of painting, is the ultimate in simplicity.

Using latex or water reduced paint requires only that the excess paint in the siphon tube 18 end dipped in the supply container be drained, wiped off, removed from the paint supply container and the open end held to a faucet outlet and flushed clean. Control handle 70, applicator 90 and hose 19 is attached to a faucet through hose connection 20 and is continuously flushed with clear water until no longer cloudy. The applicator face is worked at the same time to remove occluded coating. After the egress water runs substantially clear of discolored water the equipment is ready to store until needed. With hydrocarbon solvents, of course, a solvent wash needs to be both used to flush and also be collected. Solvent should not be discarded in a drain system as these flammable agents can also explode and are not to be rinsed into any closed waste space.

A considerable advantage of the liquid coating apparatus of this invention resides in the simplicity of the foregoing construction. The design provides an extremely light applicator both because of the simplicity and light weight of the control handle and the fact that no reservoir of liquid paint needs be lifted, balanced, supported and its applicator surface worked against the surface to be coated with more than the immediate coating being applied as the total weight. There is no return of paint or coating to the original supply, and as there is no disturbance thereof, there is no foaming or contamination by any recycle of air, paint, or dirt picked up by the selected applicator in use.

Having described the best mode presently known for the practice of the invention, but recognizing other modifications are within the spirit of this disclosure, what is claimed is:

1. Apparatus for applying a liquid coating to coatable surfaces comprising: a base; means on said base for providing cooperative support between said base and a reservoir of liquid coating material; a peristaltic pump mounted on said base, said pump having entrance and exit ports; an elongated flexible conduit having a portion thereof extending through said pump between said entrance and exit ports; said conduit outside of said entrance port being connectable in liquid transfer relationship with a liquid coating reservoir cooperatively positioned with said support; said conduit beyond said exit port being connected with applicator means for applying liquid coating material to a surface, said applicator means having a handle through which said conduit extends, a selectively operable trigger in said handle for selectively and variably constricting said conduit; said pump including a rotatable rotor assembly having a plurality of rotatable impeller rotors and an arcuate pump stator extending between said entrance and exit ports outwardly of said rotor assembly; said conduit between said entrance and exit ports being positioned beneath said stator and rotor assembly for being progressively squeezed by said rotors during rotation of said rotor assembly to pump liquid coating material to said applicator means; a motor for rotatably driving said rotor assembly and having a motor drive shaft; an epicyclic planetary gear train having an output shaft and being drivingly engaged with said motor drive shaft for providing a first substantial speed reduction from said motor drive shaft to said output shaft; said output shaft having a diameter substantially smaller than the diameter of said rotors and being drivingly engaged with said rotors for rotating same about their own axes while engaged with said conduit for rotating said rotor assembly; said output shaft, rotors and rotor assembly being sized for providing one rotation of said rotor assembly from a substantial number of rotations of said output shaft to define a second substantial speed reduction from said output shaft to said rotor assembly; said first and second speed reductions providing a combined substantial speed reduction from said motor drive shaft to said rotor assembly; and, said pump including an automatic flow rate modification control responsive to variable back pressure in said conduit downstream of said exit port caused by selective operation of said trigger.

2. The apparatus as defined in claim 1 wherein said flow rate modification control comprises said arcuate pump stator, said stator being pivoted adjacent said entrance port for movement toward and away from said rotor assembly, and yieldable biasing means adjacent said exit port for yieldably biasing said stator toward said rotor assembly.

3. The apparatus as defined in claim 1 wherein said pump includes a housing and said arcuate pump stator is pivotally connected to said housing at a first stator pivot connection adjacent said entrance port, a plate pivotally connected to said housing at a plate pivot connection adjacent said exit port and having said stator pivotally connected thereto at a second stator pivot connection spaced beyond said plate pivot connection from said entrance port, and a spring connected between said plate and housing for yieldably biasing said plate about said plate pivot connection in a direction for moving said stator toward said rotor assembly.

4. The apparatus as defined in claim 3 wherein said first stator pivot connection comprises a removable pin which is removable for swinging said stator away from said rotor assembly about said second stator pivot connection for opening said entrance and exit ports to facilitate positioning of said conduit through said pump.

5. The apparatus as defined in claim 1 wherein said means for providing cooperative support between said base and a reservoir of liquid coating material includes an undersurface on said base supportable on top of a large reservoir and support means on the upper surface of said base for stably supporting smaller sizes of reservoirs.

6. The apparatus as defined in claim 1 wherein said trigger is pivoted to said handle and has an abutment engaging said conduit for constricting same, biasing means for biasing said trigger in a direction outwardly of said handle for constricting said conduit by engagement thereof with said abutment, said trigger being manually pivotable inwardly of said handle for moving said abutment away from said conduit to relieve the constriction therein, and a slidable stop button on said handle slidable between a position opposite said abutment for cooperating therewith to constrict said conduit therebetween and a position displaced from said abutment.

* * * * *